US010071286B1

(12) United States Patent
Gajewski

(10) Patent No.: US 10,071,286 B1
(45) Date of Patent: Sep. 11, 2018

(54) SYSTEMS AND METHODS FOR DETERMINING AND INDICATING A DESIRED CORRECTIVE CHANGE IN EXERCISE TECHNIQUE

(71) Applicant: Brunswick Corporation, Lake Forest, IL (US)

(72) Inventor: Joseph J. Gajewski, Schaumburg, IL (US)

(73) Assignee: Brunswick Corporation, Mettawa, IL (US)

( * ) Notice: Subject to any disclaimer, the term of this patent is extended or adjusted under 35 U.S.C. 154(b) by 358 days.

(21) Appl. No.: 15/079,569

(22) Filed: Mar. 24, 2016

(51) Int. Cl.
*A63B 24/00* (2006.01)
*A63B 22/06* (2006.01)

(52) U.S. Cl.
CPC ..... *A63B 24/0087* (2013.01); *A63B 22/06* (2013.01); *A63B 2024/0093* (2013.01)

(58) Field of Classification Search
CPC ..... A63B 24/0087; A63B 22/06; A63B 2024/0093
See application file for complete search history.

(56) References Cited

U.S. PATENT DOCUMENTS 5,888,172 A 3/1999 Andrus et al.
6,913,560 B2 7/2005 Ryan et al.
7,228,168 B2 6/2007 Dardik et al.
8,021,278 B2 9/2011 Huyck et al.
2005/0221960 A1* 10/2005 Miyamaru ..... A63B 22/0605 482/57
2013/0032413 A1* 2/2013 Smith ..... 177/1
2013/0237385 A1* 9/2013 Sun ..... A63B 22/0046 482/57
2014/0296750 A1* 10/2014 Einav ..... A61B 34/30 601/5
2014/0364285 A1* 12/2014 Moschel ..... A63B 21/062 482/98
2015/0367176 A1* 12/2015 Bejestan ..... G06F 19/3481 482/9
2016/0144915 A1* 5/2016 Bejestan ..... B62J 99/00 340/432
2016/0158603 A1* 6/2016 Darwood ..... G06F 19/3481 482/5
2017/0007886 A1* 1/2017 Alessandri ..... G06F 19/3481

* cited by examiner

*Primary Examiner* — Andrew S Lo
(74) *Attorney, Agent, or Firm* — Andrus Intellectual Property Law, LLP

(57) ABSTRACT

Systems and methods are for determining and indicating a desired corrective change in exercise technique to an operator and optionally for determining and indicating a correct or incorrect fit between an operator and an exercise equipment. The systems comprise an exercise apparatus that is engaged by an operator at least a first contact location; a first load sensor device that senses an operator-applied load amount at the first contact location; a controller that determines a desired corrective change in exercise technique and/or the correct or incorrect fit between the operator and the exercise equipment based at least upon the operator-applied load amount at the first contact location and a current body weight of the operator; and an indicator device that indicates the desired corrective change in exercise technique and/or correct or incorrect fit, for example to an operator or an instructor.

23 Claims, 9 Drawing Sheets

SYSTEMS AND METHODS FOR DETERMINING AND INDICATING A DESIRED CORRECTIVE CHANGE IN EXERCISE TECHNIQUE

FIELD

The present disclosure relates to exercise equipment, and more particularly to systems and methods for determining and indicating a desired corrective change in exercise technique, for example to an operator and/or an exercise instructor.

BACKGROUND

The following U.S. Patents are hereby incorporated herein by reference, in entirety.

U.S. Pat. No. 8,021,278 discloses several mechanisms for permitting a operator to adjust the seat on a stationary exercise bicycle. The described mechanisms can be used to adjust the height of the seat or the fore and aft positioning of the seat on an upright type bicycle. Each of the described mechanisms can be configured to provide operators with an optimum seat position and with a convenient latch mechanism to adjust the position of the seat.

U.S. Pat. No. 6,913,560 discloses a stationary exercise bicycle having a frame, a resistance member, a drive assembly, a right pedal, a left pedal, a seat and an adjustable seat mechanism utilizing a rack. Assembly and disassembly of a three piece crank arm assembly is accomplished without requiring the assembling and disassembling of the entire drive assembly. The stationary exercise bicycle also provides a variety of operators with an optimum seat position and with a convenient latch mechanism to adjust the position of the seat.

U.S. Pat. No. 5,888,172 discloses a physical exercise video system that includes a physical exercise machine, a video system and an interface module. The video system has a computer and a removable cartridge. The interface module is interposed between the computer and cartridge, and provides interactive communications between the computer and exercise machine. A communication protocol governs this communication, and includes specifications for status and command data packets. The video system and exercise machine can be selectively operated as either stand-alone units, or in an interactive exercise mode, wherein the exercise data by the exercise machine affects the output of the video system, and may also be stored in memory within the interface module. The video system controls the operation of the exercise machine generally, and specifically, controls the load resistance imposed in opposition to the movement of pedals. The control of load resistance by video system is a function of the operating characteristics of the exercise machine.

SUMMARY

This Summary is provided to introduce a selection of concepts that are further described herein below in the detailed description. This Summary is not intended to identify key or essential features of the claimed subject matter, nor is it intended to be used as an aid in limiting the scope of the claimed subject matter.

Exemplary systems are herein disclosed for determining and indicating a desired corrective change in exercise technique to an operator. The systems can comprise an exercise apparatus that is engaged by an operator at a first contact location and at a second contact location. A first load sensor device senses an operator-applied load amount at the first contact location. A controller determines a desired corrective change in exercise technique based upon the operator-applied load amount at the first contact location and a current body weight of the operator and controls an indicator device to indicate the desired corrective change in exercise technique, for example to the operator or to an instructor.

In certain examples, the exercise equipment comprises a handle member that is configured to be manually grasped by an operator and a seat member that is configured to be sat on by the operator. The first load sensor device is configured to sense an operator-applied load amount on the handle member. The controller determines the desired corrective change in operator posture based upon the operator-applied load amount at the handle member and the current body weight of the operator. The controller controls an indicator device to indicate the desired corrective change in operator posture, for example to the operator or to an instructor.

The present disclosure also provides methods for determining and indicating a desired corrective change in exercise technique to an operator. The methods can comprise operating an exercise apparatus that is engaged by an operator at a first contact location and a second contact location; sensing an operator-applied load amount at the first contact location; determining the desired corrective change in exercise technique based upon the operator-applied load amount at the first contact location and a current body weight of the operator; and indicating the desired corrective change in exercise technique, for example to the operator or to an instructor.

Systems and methods are provided for determining and indicating a correct or incorrect fit between an operator and exercise equipment. In certain examples, the system comprises an exercise apparatus that is engaged by an operator during exercise at a first contact location, at a second contact location, and at a third contact location; first, second and third load sensor devices that are configured to sense the respective operator-applied load amounts at the first, second and third contact locations; a controller that is configured to determine a correct or incorrect fit between the operator and the exercise apparatus based upon the operator-applied load amounts at the first, second and third contact locations and a current body weight of the operator; and an indicator device that is configured to indicate the correct or incorrect fit between the operator and the exercise apparatus, for example to the operator or an instructor.

BRIEF DESCRIPTION OF THE DRAWINGS

Examples of systems, methods and exercise equipment are described with reference to the following Figures. The same numbers are used throughout the Figures to reference like features and components.

DETAILED DESCRIPTION OF THE DRAWINGS

Figure 1:
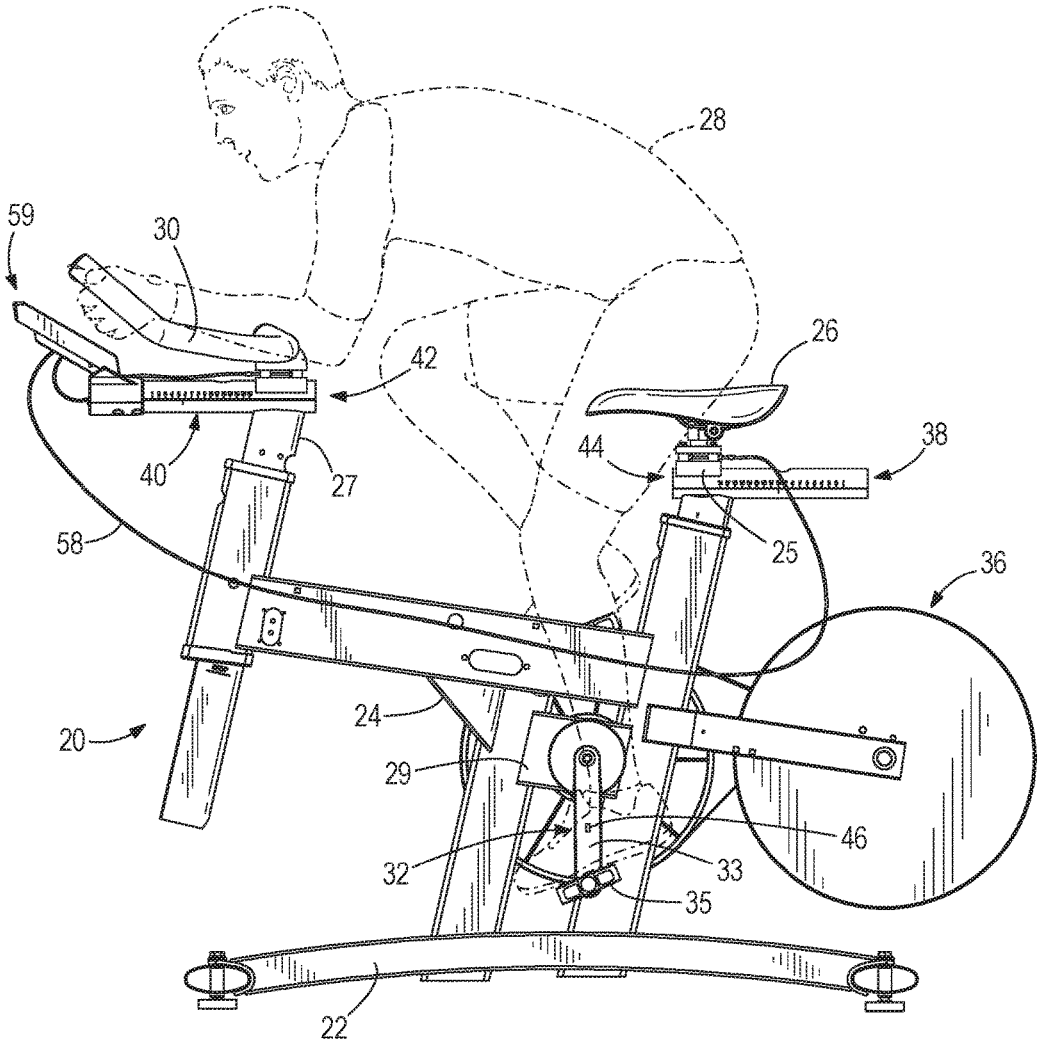
FIG. 1 is a side view of an exercise apparatus, in this example a stationary cycle.

Through research and experimentation in the field of exercise equipment, the present inventor has realized that it is important to maintain proper technique (e.g. posture) during exercising, especially cycling. The inventor has realized that it is also beneficial to ensure that the exercise equipment, for example a stationary cycle, properly fits the operator. This is true for individual exercises and for example group exercise classes. Often, when an operator get tired, he or she starts leaning forward on the exercise equipment, which results in poor exercise technique. In a group setting, an attentive instructor will tell the group of operators to correct their technique, including posture. However, this does not always happen. For example, the instructor may not be attentive to all of the operators or may be distracted by other concerns. When exercising individually, the operator must rely on his or her own perception and knowledge to maintain proper technique. This can often be difficult and, for example when the operator is under mental fatigue, the operator likely will not maintain the proper technique. The operator must also understand proper fit for the exercise equipment; however unfortunately many operators and/or instructors are not knowledgeable enough to properly fit the exercise equipment.

The present inventor has recognized that it would be advantageous to provide improved exercise equipment, systems and methods that are configured to automatically help operators learn and maintain proper exercise technique and help instructors of groups ensure that the students are maintaining proper exercise technique. The present inventor has recognized that it would be advantageous to provide improved exercise equipment, systems and methods that are configured to automatically help operators and instructors properly fit the exercise equipment to the operator.

Through research and experimentation the present inventor has determined that by placing one or more load sensor devices on the exercise equipment, such as for example on the handlebars of a stationary cycle, it is possible to sense and monitor the load the operator is placing on the handlebars. With this information and the operator's current weight, which for example can be input into a controller for exercise equipment via an input device, can be used to determine current exercise technique of the operator and then inform the operator when he or she needs to correct their technique.

Through research and experimentation, the present inventor has also determined that by placing one or more load sensor devices at one location of the exercise equipment, for example the handlebars of the noted stationary cycle, and one or more load sensor devices at another location of the exercise equipment, such as the support seat of the noted stationary cycle, it is possible to sense and monitor the load the operator is placing on the exercise equipment at both locations, and then calculate the split in load between the locations in real time. This information along with the operator's current weight can be used to determine the operator's current technique, such as the operator's current posture and then inform the operator regarding a suggested corrective technique.

Through research and experimentation, the present inventor has also determined that by placing load sensor devices at three different locations of the exercise equipment, such as on the handlebars, saddle, and bottom bracket for supporting the pedals of the noted stationary cycle, it is possible to monitor the operator-applied load distribution across three contact points on the exercise equipment. This not only allows the operator to be informed if their posture was correct but can also be used to indicate if the operator has the exercise equipment correctly fit to their body.

Through research and experimentation, the present inventors has determined that the information collected from the one or more load sensor devices can be analyzed and compared to known weight distributions for proper fit to thereby indicate, for example on a display console, to the operator that the fit is correct or incorrect and/or that the operator's posture or body position needs to be changed.

FIGS. 1-4 depict one example of exercise equipment, which in this example is a stationary cycle 20. It should be recognized that the concepts of the present disclosure are not limited for use with the depicted stationary cycle, and in fact are not limited for use with stationary cycles. The concepts of the present disclosure can be used with different types of stationary cycles and/or other exercise equipment, such as road bicycles, mountain bicycles, stepper apparatuses, life-cycle apparatuses, and/or the like.

An operator 28 of the stationary cycle 20 is shown in phantom line. The stationary cycle 20 includes a supporting base 22 and a frame 24 that is supported above the ground by the supporting base 22. The frame 24 has a seat post 25 that supports a seat member 26 on which the operator 28 sits while operating the stationary cycle 20. The frame 24 also has a handle post 27 that supports a handle member 30. The frame 24 also has a bottom bracket 29 that supports opposing pedal members 32 on opposite sides of the frame 24. Pedal members 32 have crank arms 33 and pedals 35 and are configured for engagement by the feet of the operator 28. In use, the pedal members 32 are engaged by the operator's feet and are rotatable with respect to the frame 24 in a conventional cycling motion. A resistance mechanism, such as a flywheel 36, can be provided to resist the cycling motion. In the illustrated example, the distance between the seat member 26 and the handle member 30 is adjustable via conventional adjustment devices 38, 40; however, these features are not essential and the type and configuration of the stationary cycle 20 can vary from what is shown.

In use, as shown in FIG. 1, the operator 28 leans forward on the handle member 30 and has a certain body posture. When the operator 28 becomes fatigued, the operator 28 will have a tendency to lean too far forward onto the handle member 30, which can result in poor posture and thus poor riding technique. This can decrease performance and possibly pose health risks to the operator 28 if he or she maintains this poor riding technique for long periods of time and/or over many exercise routines.

FIGS. 1-4 depict an example wherein the above-mentioned load sensor devices are placed at three locations at which the stationary cycle 20 is contacted by the operator, namely the handle member 30, the seat member 26 and the pedal members 32. However, as discussed herein above, other examples can include one or more than one load sensor device at only one of these locations or only two of these locations, or at more that the three locations on the stationary cycle 20. Thus, while the illustrated example shows sensors at three specific locations, the present disclosure is not limited to this particular arrangement.

Figure 2:
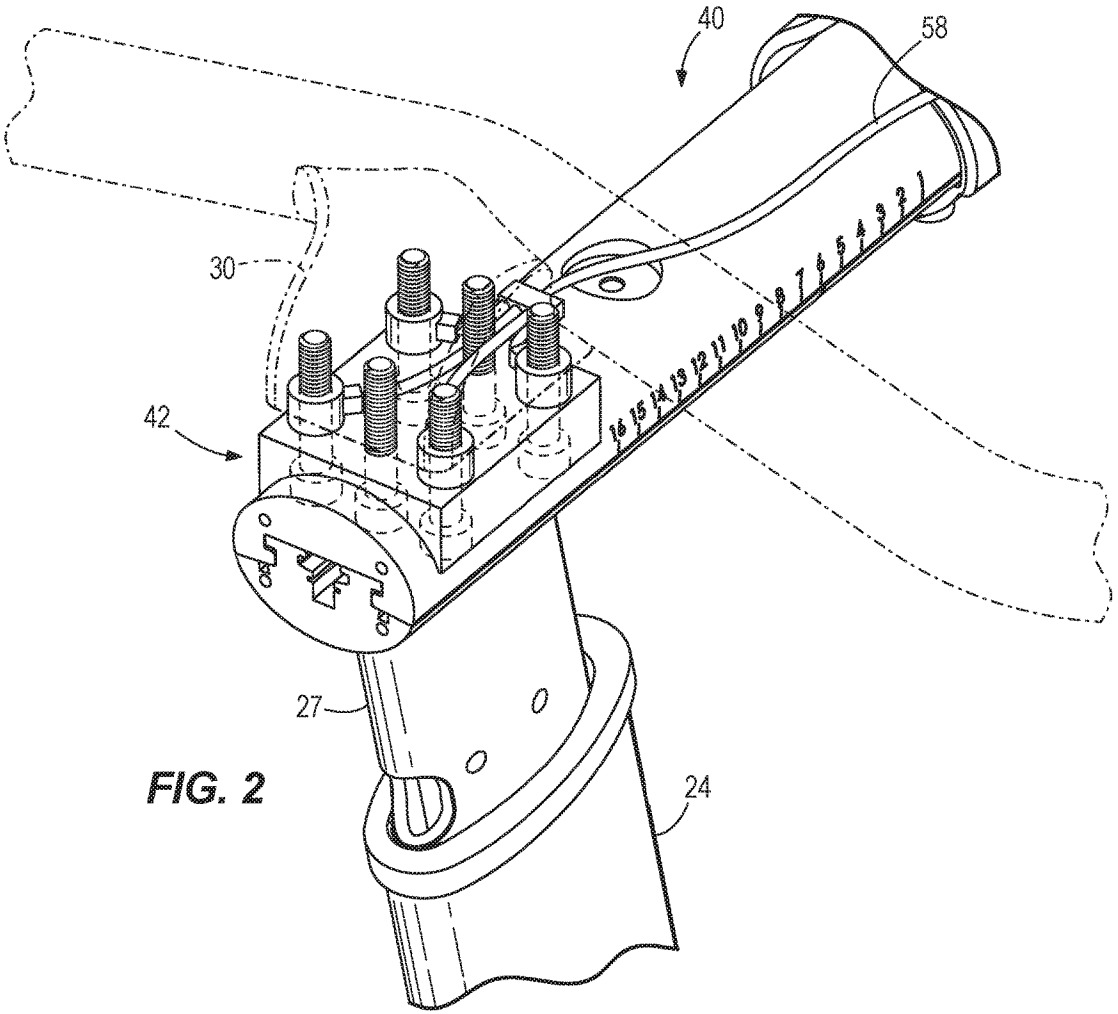
FIG. 2 is a front perspective view looking down at a first load sensor device that is coupled to a handle member of the stationary cycle.

Referring to FIG. 2, a first load sensor device 42 is coupled to the handle member 30 and is configured to sense an operator-applied load amount on the handle member 30. The illustrated example, the first load sensor device 42 includes multiple load sensors that are each configured as through-hole bolt load cells. The configuration of load cells are selected based upon the anticipated loading that the operator 28 would typically input to the system via the handle member 30 during exercise. One example of a suitable through-hole-bolt-type load sensor device 42 for this arrangement is available from Omega Engineering Inc., Part No. LC8150-250-100. Another example of a suitable load sensor device 42 for this arrangement is available from Omega Engineering Inc., Part No. LCPB-100.

Figure 5:
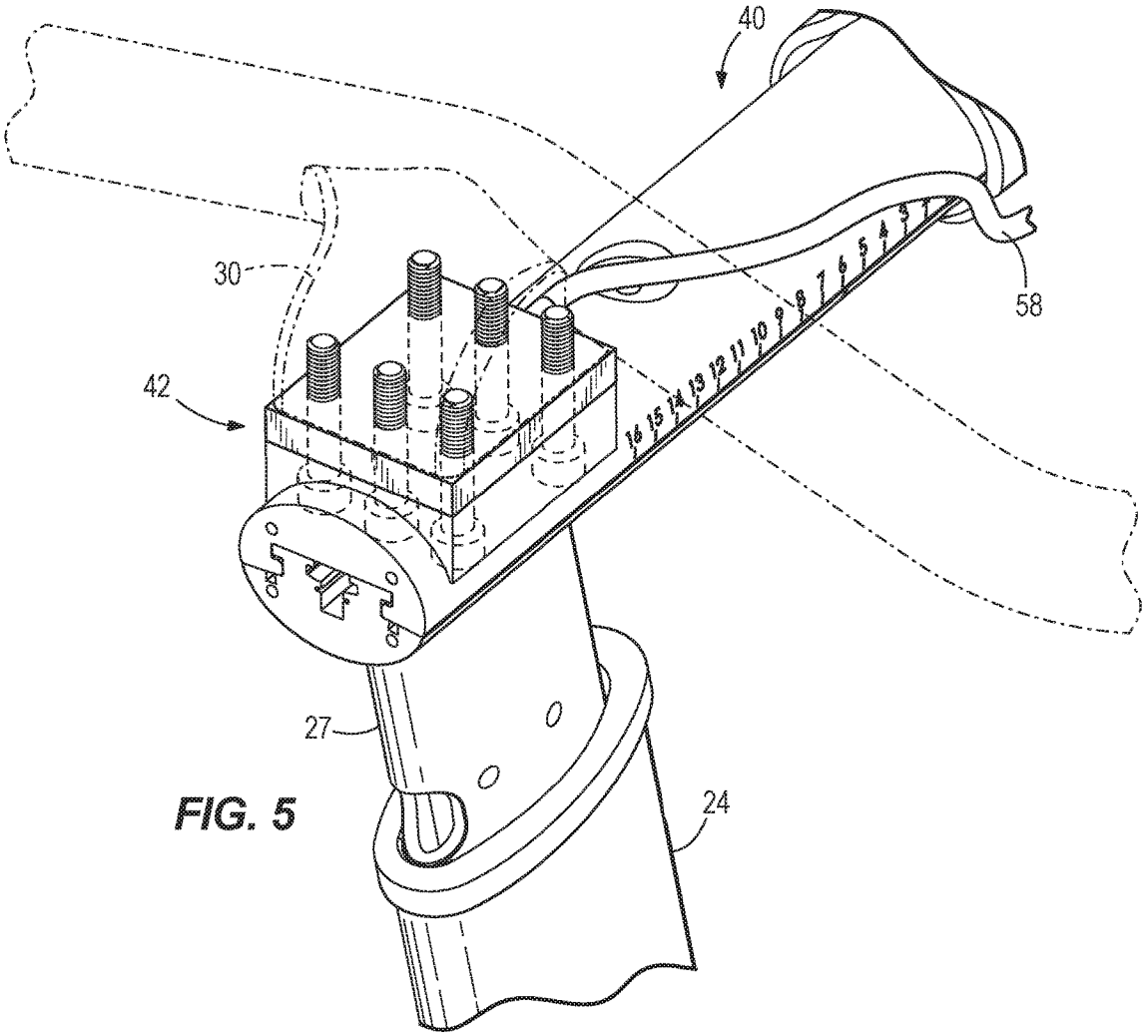
FIG. 5 is a view like FIG. 2, depicting an alternate example of a first load sensor device.

FIG. 5 depicts an alternate example of the first load sensor device 42, which in this example is a single load sensor configuration having a load cell that is configured based on the anticipated loading that the operator would input to the handle member 30. The size and attachment methods can vary depending upon the configuration of the handle member 30. The first load sensor device 42 shown in FIG. 5 can be similar in design and function to a platform load cell or a bending beam load cell. An example of a bending beam load cell sensor device is available from Omega Engineering Inc., Part No. LCJA-500. An example of a platform load cell is available from Omega Engineering Inc., Part No. LCMAD-250.

Figure 3:
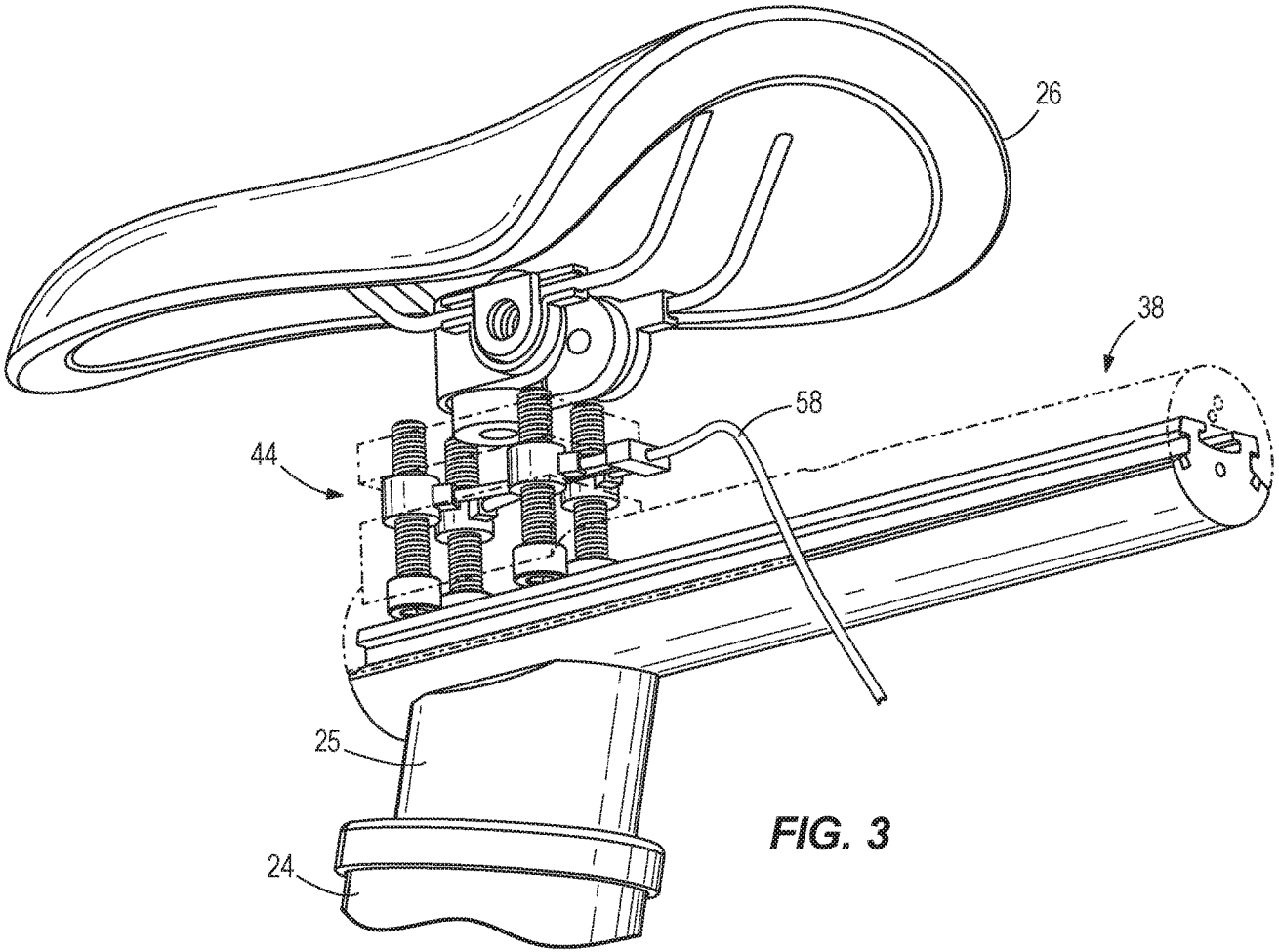
FIG. 3 is a rear perspective view looking up at a second load sensor device that is coupled to a support seat of the stationary cycle.
Figure 6:
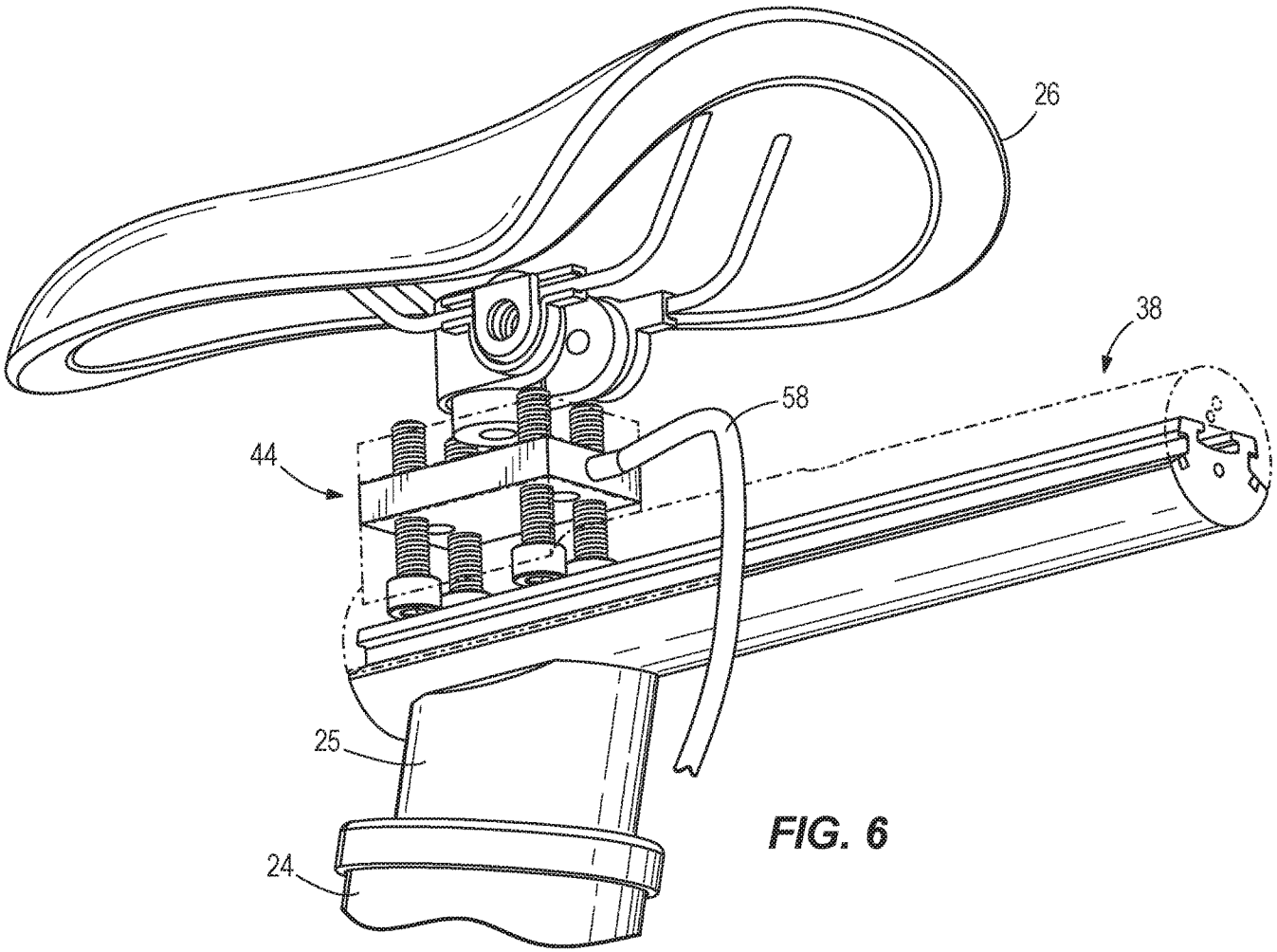
FIG. 6 is a view like FIG. 3, depicting an alternate example of a second load sensor device.

Referring to FIGS. 3 and 6, examples of a second load sensor device 44 are configured to sense an operator-applied load amount on the seat member 26. The type and configuration of the second load sensor devices 44 shown in FIGS. 3 and 6 can be configured in the same or similar manner as described herein above regarding the first load sensor device 42 shown in FIGS. 2 and 5, respectively.

Figure 4:
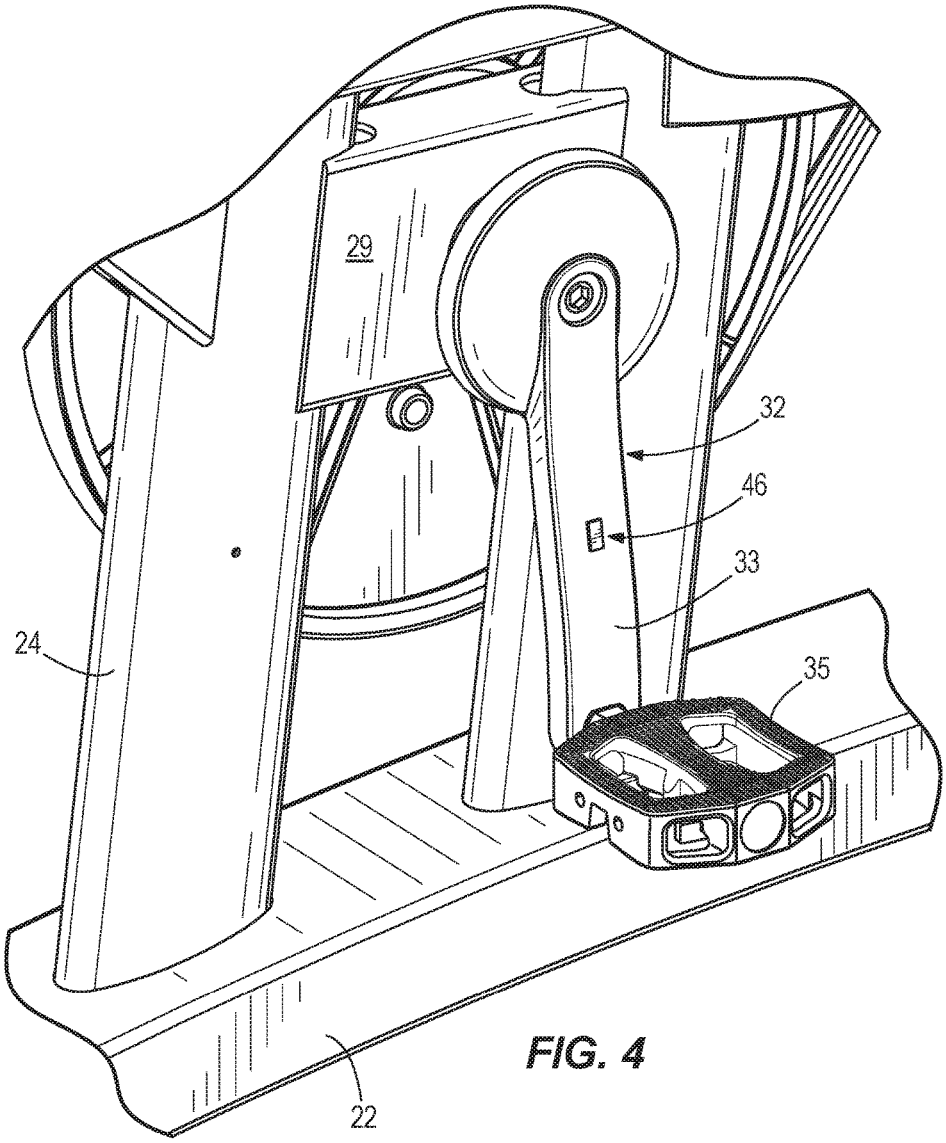
FIG. 4 is a side perspective view looking down at a third load sensor device that is coupled to a pedal member of the stationary cycle.

FIG. 4 depicts a third load sensor device 46, which is configured to sense an operator-applied load amount on the pedal member 34. The type and location of third load sensor device 46 can vary from that which is shown. The example shows a strain gauge positioned on each pedal member 34. In this arrangement, the operator-applied load on the bottom bracket 29 can be determined by measuring the strain in both crank arms 33. Several conventional types of strain gauges could be used and are available from Omega Engineering Inc. In other examples, the third load sensor device 46 can be located at the bottom bracket 29, for example where the bottom bracket engages the rest of the frame 24. The configuration of the third load sensor device 46 can be similar to the examples given herein above for the first and second load sensor device 42, 44.

Figure 7:
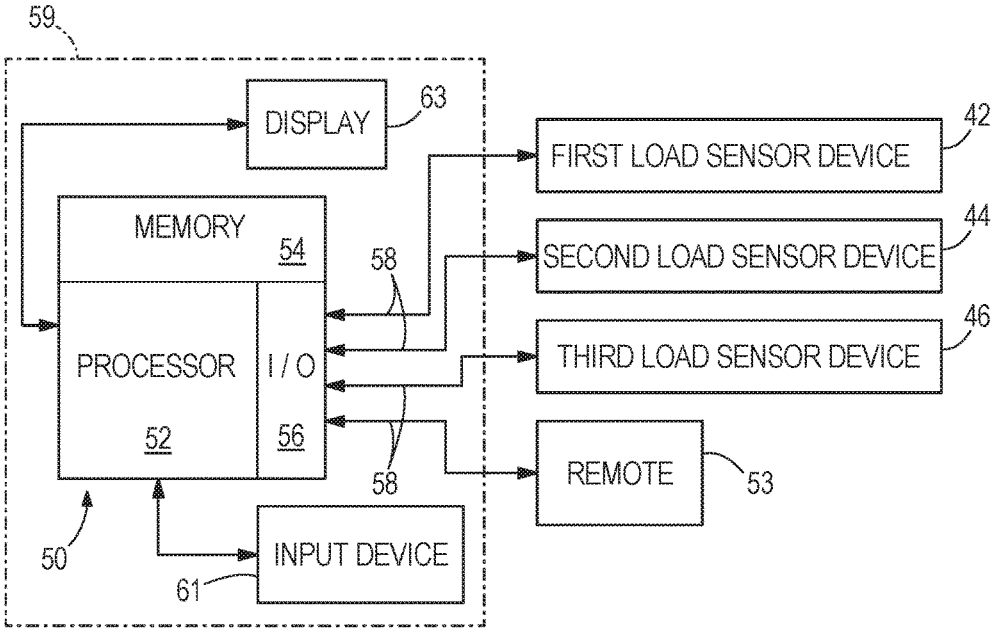
FIG. 7 is a schematic view of an exemplary system according to the present disclosure.

Referring to FIG. 7, a controller 50 is configured to receive the operator-applied load amounts sensed by the first, second and/or third load sensor devices 42, 44, 46. The controller 50 includes a processor 52 that is configured to calculate and determine a desired corrective change in exercise technique, such as operator posture and/or fit between the operator 28 and the stationary cycle 20, based upon the inputs received from the first, second and/or third load sensor devices 42, 44, 46. The controller 50 includes a memory 54 that stores a lookup table that correlates known data related to operator-applied load amounts to operator technique (e.g. posture and/or to correct/incorrect fit between the operator 28) and the stationary cycle 20. The data in the lookup table can be based on historical data from testing and/or trial and error. The controller 50 also includes a conventional input/output device 56 for sending and/or receiving electronic signals from the first, second, and/or third load sensor devices 42, 44, 46 via communication links 58. The communication links 58 can be wired or wireless.

In the illustrated example, the stationary cycle 20 includes a console 59 that houses the controller 50. This is just one example, and the console 59 is not essential. In this example, the console 59 incorporates an input device 61, such as for example a touch screen or keypads, via which the operator 28 can input his or her current weight to the controller 50. The console 59 also includes an indicator device, for example a display 63, for conveying information associated with the stationary cycle 20 to the operator 28. As is conventional, the operator 28 can also select or input a certain exercise routine into the input device 61, which is carried out by the controller 50, for example by controlling the resistance device (flywheel 36) or other conventional mechanisms of the stationary cycle 20. In some examples, the controller 50 can be located remotely from the stationary cycle 20, for example at an instructor's location. In some examples, the controller 50 can be configured to communicate via the Internet or any other suitable communication link to, for example, a remote control location 53 which can in some examples include a website from which the operator 28 can view data from his or her exercise routine.

Thus, although FIG. 7 shows one controller 50, there can be more than one controller 50. Portions of the methods described herein can be carried out by a single controller or by several separate controllers. Each controller can have one or more control sections or control units. In some examples, the controller 50 can include a computing system that includes a processing system (e.g. processor 52), storage system (e.g. memory 54), software, and input/output (I/O) interfaces (e.g. input/output device 56) for communicating with devices described herein and with other devices. The processing system can load and execute software from the storage system. When executed, display software directs the processing system to operate as described herein to execute image display or notification on a display, such as on console 59 and/or on a remote display.

The computing system may include one or many application modules and one or more processors, which may be communicatively connected. The processing system may comprise a microprocessor (e.g., processor 52) and other circuitry that retrieves and executes software from the storage system. Processing system can be implemented within a single processing device but can also be distributed across multiple processing devices or sub-systems that cooperate in existing program instructions. Non-limiting examples of the processing system include general purpose central processing units, applications specific processors, and logic devices.

The storage system (e.g., memory 54) can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can further include additional elements, such as a controller capable of communicating with the processing system. Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

In this example, the controller 50 communicates with one or more components of the system via communication links 58, which can be a wired or wireless links. The controller 50 is capable of monitoring and/or controlling one or more operational characteristics of the system and its various subsystems by sending and receiving control signals via the communication links 58. It should be noted that the extent of connections of the communication link 58 shown herein is for schematic purposes only, and the communication links 58 in fact provides communication between the controller 50 and each of the sensors, devices, and various subsystems described herein, although not every connection is shown in the drawing for purposes of clarity. The controller 50 can control the display(s), and the controller 50 may coordinate display information on multiple displays 63.

As discussed above, the illustrated examples contemplate at least three different embodiments, including a first embodiment wherein the controller 50 is configured to determine the desired corrective change in operator posture by comparing only the operator-applied load amount on the handle member to the look-up table; a second embodiment wherein the controller 50 is configured to calculate the desired corrective change in operator posture based upon the operator-applied load amount at the handle member 30 and the operator-applied load amount at the seat member 26; and a third embodiment wherein the controller 50 is configured to calculate the desired corrective change in operator posture and/or a need for change in fit of the exercise equipment based upon the operator-applied load amount at the handle member, the seat member 26 and the bottom bracket 29. Examples of these three embodiments are further described herein below with reference to FIGS. 8-11, respectively.

Figure 8:
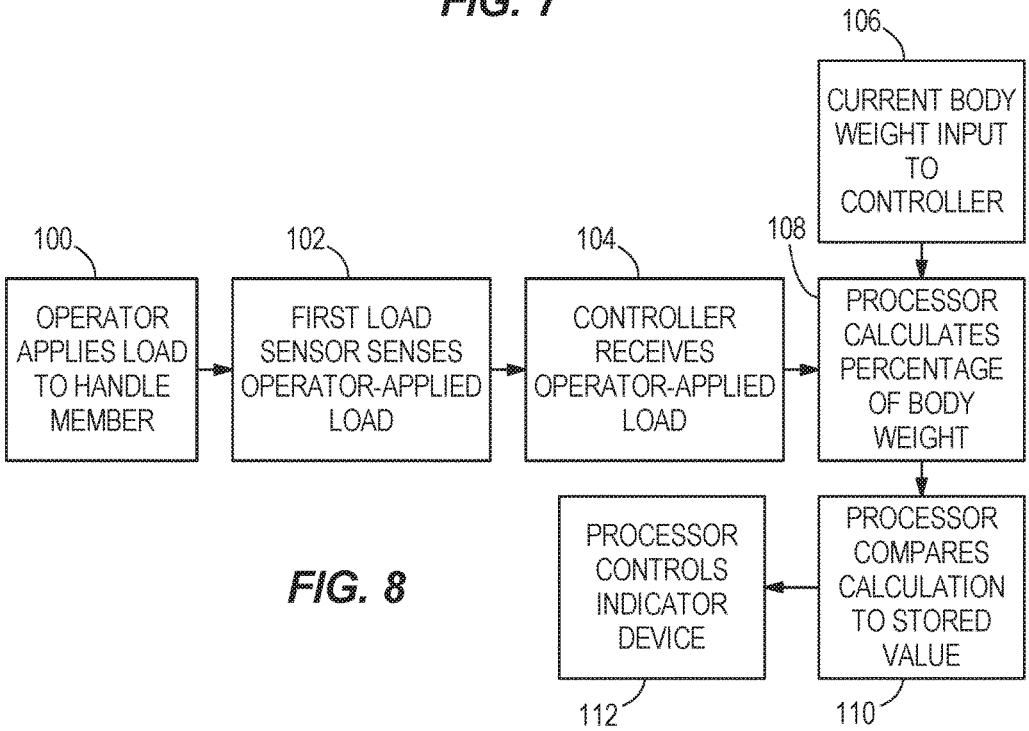
FIG. 8-10 are flow charts depicting exemplary methods according to the present disclosure.

Referring to FIG. 8, in a first embodiment, at step 100, the operator 28 applies a load to the handle member 30 during exercise on the stationary cycle 20, for example leaning forward on the handle member 30 (see FIG. 1). At step 102, the first load sensor device 42 senses the operator-applied load on the handle member 30. At step 104, the controller 50 receives the sensed operator-applied load from the first load sensor device 42. At step 106, the current body weight of the operator 28 is inputted into the controller 50, via for example the input device 61 on the console 59 or from historical data stored in the memory 54. Step 106 can occur before or after step 100, but should occur before step 108. At step 108, the processor 52 calculates a weight distribution percentage of the current body weight of the operator 28 loaded on the handle member 30. At step 110, the processor 52 compares the calculated weight distribution percentage to values stored in the memory 54 (for example in a lookup table) and determines whether the percentage is greater than a defined "acceptable" percentage. The values stored in the controller 50 can be based on historical data from prior testing and/or based on known principles for proper exercise technique. If the calculated weight distribution percentage is outside of an acceptable limit stored in the memory 54, the controller 50 at step 112 causes the display 63 on the console 59 to indicate to the operator 28 that it is necessary to correct the operator's posture/technique. This method can repeat during further use of the exercise equipment to periodically or continuously provide feedback regarding the operator's posture and/or technique. In some examples, the controller 50 can be configured to indicate the operator's approximate current posture (based on the comparison made by the controller 50) and also a corrective action that is necessary. A non-limiting example of the method in FIG. 8 is provided herein below under the subheading Example A.

Figure 9:
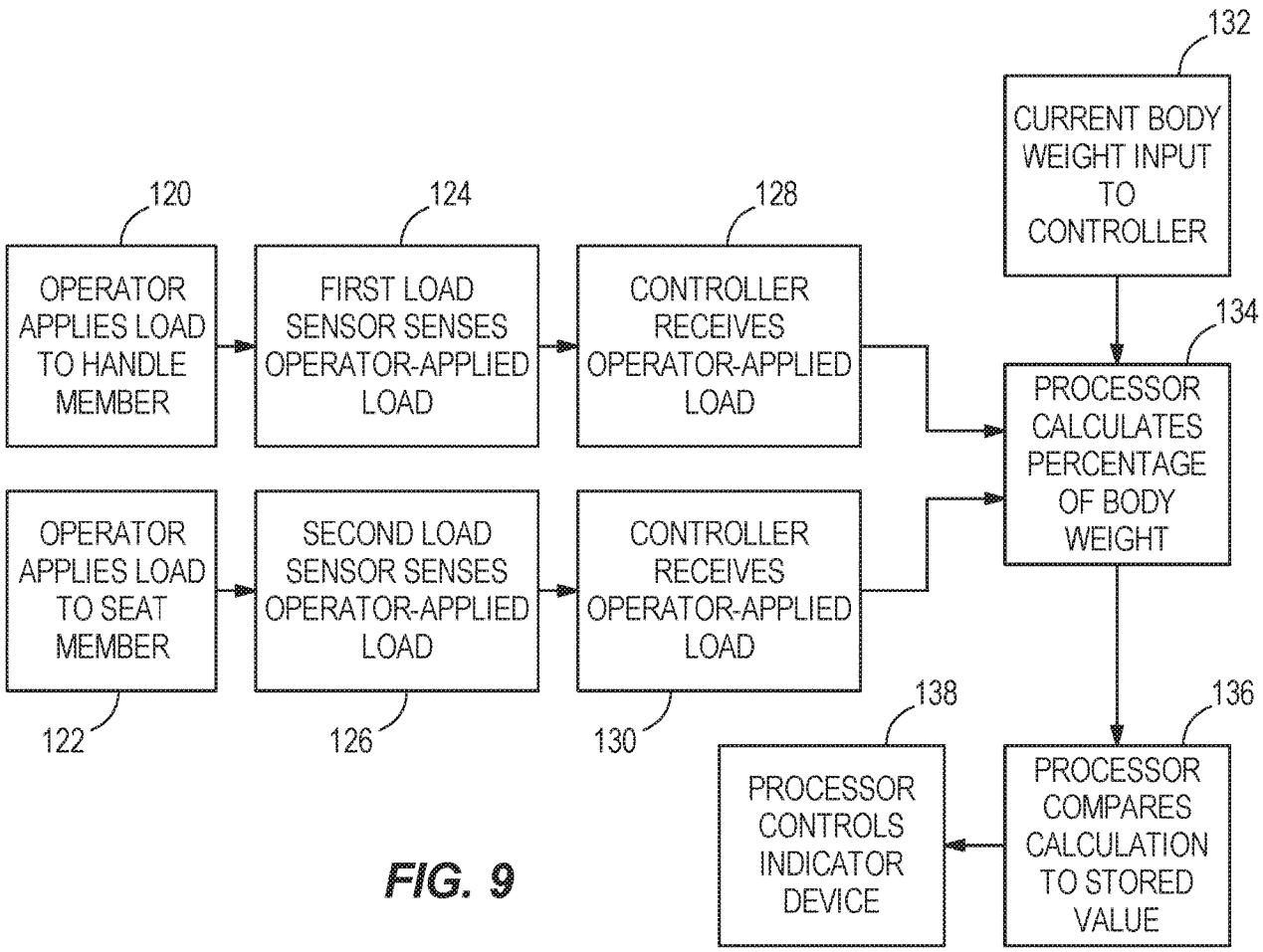

Referring to FIG. 9, in a second embodiment, at steps 120 and 122, the operator 28 applies a load to the handle member 30 and to the seat member 26, respectively, during exercise on the stationary cycle 20. At steps 124 and 126, the first load sensor device 42 and second load sensor device 44 sense the operator-applied load on the handle member 30 and the seat member 26, respectively. At steps 128 and 130, the controller 50 receives the sensed operator-applied load from the first and second load sensor devices 42, 44, respectively. At step 132, the current body weight of the operator 28 is inputted into the controller 50, via for example the input device 61 on the console 59 or from historical data stored in the memory 54. Step 132 can occur before or after steps 120 and/or 122, but should occur before step 134. At step 134, the processor 52 calculates a body weight distribution percentage between the first and second load sensor devices 42, 44, such as for example a split load amount. At step 136, the processor 52 compares the calculated weight distribution percentage to a value stored in the memory 54 (for example in a lookup table) to determine how the calculated weight distribution percentage (e.g. split load amount) correlates to one or more stored weight distribution percentages associated with desired operator postures and/or techniques. As explained herein above, the stored values can be based on historical data associated with proper exercise technique. If the calculated weight distribution percentage is outside of a stored weight distribution associated with a desired operator posture or technique, the controller 50, at step 138 is configured to control the display 63 on the console 59 to indicate to the operator 28 that it is necessary to correct the operator's posture and/or other technique. The method can repeat during further use of the exercise equipment to periodically or continuously provide feedback regarding the operator's posture and/or other technique. In some examples, the controller 50 can be configured to indicate the operator's approximate current posture or other technique and also a corrective action that is necessary. Non-limiting examples of the method in FIG. 9 are provided herein below under the subheadings Example B 1, Example B2 and Example B3.

Figure 10:
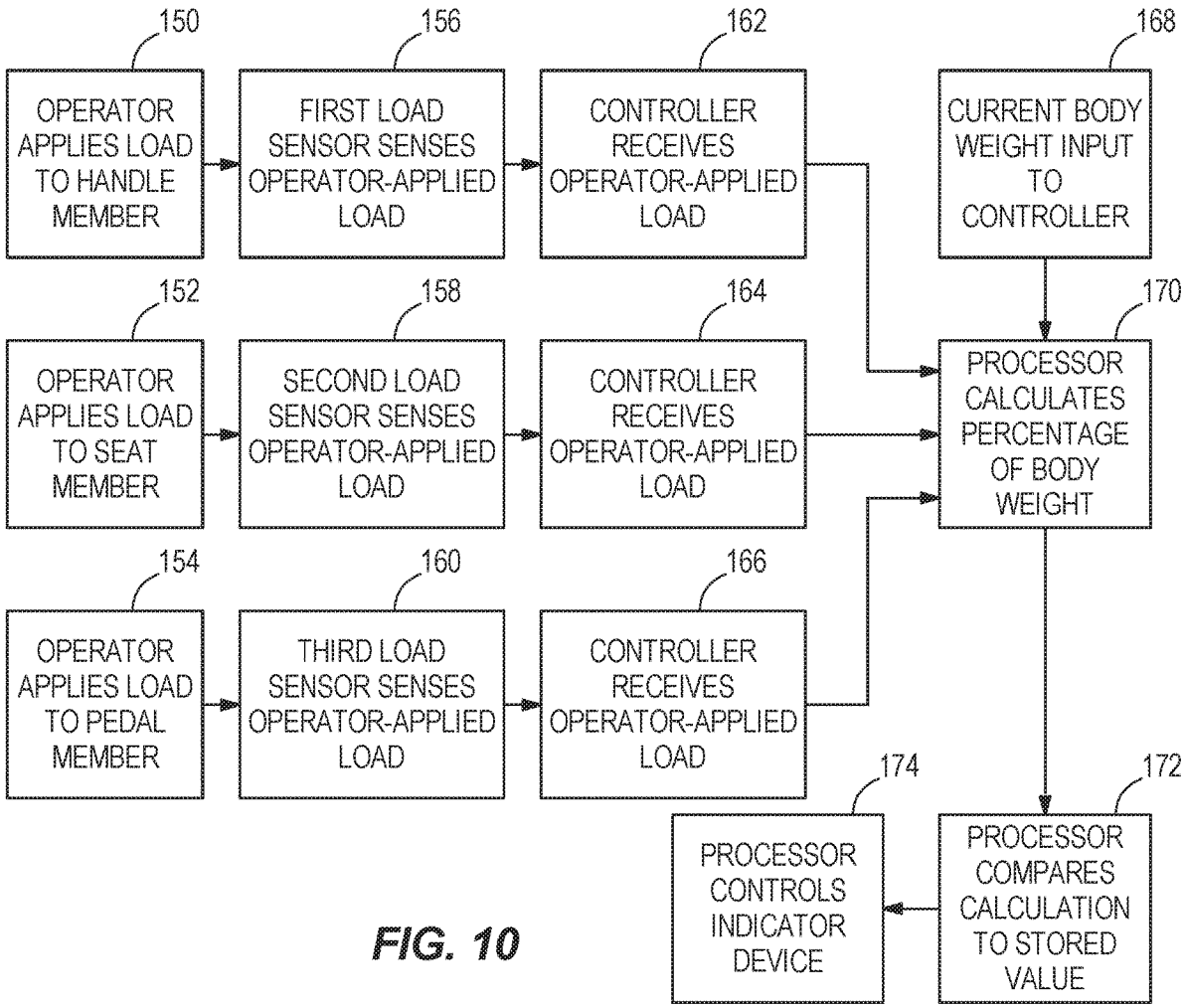

Referring to FIG. 10, in a third embodiment, at steps 150, 152, and 154, the operator 28 applies a load to the handle member 30, to the seat member 26, and to the pedal members 32, respectively, during exercise on the stationary cycle 20. At steps 156, 158, 160, the first load sensor device 42, second load sensor device 44 and third load sensor device 46 sense the operator-applied loads on the handle member 30, seat member 26, and pedal members 32, respectively. At steps 162, 164 and 166, the controller 50 receives the sensed operator-applied loads from the first, second and third load sensor devices 42, 44, respectively. At step 168, the current body weight of the operator 28 is inputted into the controller 50, via for example the input device 61 on the console 59 or from historical data stored in the memory 54. Step 168 can occur before steps 150 and/or 152 and/or 154, but should occur before step 168. At step 170, the processor 52 calculates a body weight distribution percentage between the first, second and third load sensor devices 42, 44, 46. At step 172, the processor 52 compares the calculated weight distribution percentage to a value stored in the memory 54 (for example in a lookup table) to determine how the calculated weight distribution percentage correlates to one or more stored weight distribution percentages associated with desired operator postures and/or techniques. If the calculated weight distribution percentage is outside of a stored weight distribution associated with a desired operator posture or technique, the controller 50, at step 174 is configured to control the display 63 on the console 59 to indicate to the operator 28 that it is necessary to correct the operator's posture and/or technique. The method can repeat during further use of the exercise equipment to periodically or continuously provide feedback regarding the operator's posture and/or technique. In some examples, the controller 50 can be configured to indicate the operator's approximate current posture or technique and/or a corrective action that is necessary. Non-limiting examples of the method in FIG. 10 are provided herein below under the subheadings Example C1 and Example C2.

As mentioned herein above, in examples where three or more load sensor devices are utilized, the controller 50 can be programmed to indicate to the operator 28 or the operator's instructor that the exercise apparatus is not properly fit to the operator's body. The controller 50 can control the console 59 or other device to indicate to the operator 28 that an adjustment of the exercise equipment is needed. A non-limiting example is provided herein below under the subheading Example C3.

It will thus be seen that the present disclosure provides systems for determining and indicating a desired corrective change in exercise technique. In certain examples, the system comprises an exercise apparatus that is engaged by an operator during exercise at a first contact location and at a second contact location; a first load sensor device that senses an operator-applied load amount at the first contact location; a controller that determines a desired corrective change in exercise technique based upon the operator-applied load amount at the first contact location and a current body weight of the operator; and an indicator device that indicates the desired corrective change in exercise technique.

In certain examples, the exercise technique comprises a posture of the operator. The controller can comprise a memory that stores a look-up table that correlates operator-applied load amounts to stored corrective changes in exercise technique. The controller can determine the desired corrective change in exercise technique by comparing the operator-applied load amount at the first contact location to the look-up table. In some examples, a second load sensor device is configured to sense an operator-applied load amount at the second contact location, wherein the controller is further configured to calculate the desired corrective change in exercise technique based upon the operator-applied load amount at the first contact point, the operator-applied load amount at the second contact point, and the current body weight of the operator. In some examples, the controller is configured to calculate a split load amount between the operator-applied load amount at the first contact point and the operator-applied load amount at the second contact point. The desired corrective change in exercise technique is calculated based upon the split load amount and the current body weight of the operator. In some examples, a third contact location is engaged by the operator during exercise, and the system further comprises a third load sensor device that is configured to sense an operator-applied load amount at the third contact location. The controller is configured to calculate the desired corrective change in exercise technique based upon the operator-applied load amount at the first contact location, the operator-applied load amount at the second contact location, the operator-applied load amount at the third contact location, and the current body weight of the operator. The controller is configured to calculate a load amount distribution the operator-applied load amount at the first contact location, the operator-applied load amount at the second contact location, and the operator-applied load amount at the third contact location. The desired corrective change in operator posture is calculated based upon the load amount distribution and the current body weight of the operator.

In some examples, the exercise apparatus comprises a stationary cycle, wherein the first contact location is a handle member of the stationary cycle, wherein the second contact location is a support seat of the stationary cycle, and wherein the third contact location is a pedal member of the stationary cycle. The indicator device can comprise a display configured to display the desired corrective change in operator posture. An input device can be configured to input the current body weight of the operator to the controller.

It will thus also be seen that the present disclosure provides a method for determining and indicating a desired corrective change in exercise technique. The method can comprise: operating an exercise apparatus that is engaged by an operator at a first contact location and at a second contact location; sensing an operator-applied load amount at the first contact location; determining a desired corrective change in exercise technique based upon the operator-applied load amount at the first contact location and a current body weight of the operator; and indicating the desired corrective change in exercise technique.

The following are example calculations for certain embodiments of the controller. The calculations and numerical values in the following examples are not limiting on the scope of the invention and are for exemplary purposes only:

Example A

1. Operator operates exercise equipment
2. Operator inputs body weight into controller
3. Operator applies load to handle member
4. Load at handle member is measured by sensors
5. Load as a percentage of operators weight is determined at handle member
6. Percentage is looked up from stored data
   Example of calculation (percentage values and percentage ranges are estimated for demonstration purposes)
   Operator weight: 200 lbs.
   Operator loading at handle member: 50 lbs.
   Operator weight percentage at handle member: 25%
   If: handle member percentage≤25%
   Then: proper form
   Display "proper riding form" or display nothing
   If: handle member percentage>25%
   Then: improper form
   Display "fix form" or other informative message Example B1

1. Operator operates exercise equipment
2. Operator inputs body weight into controller
3. Operator applies load to handle member and seat member
4. Loads at handle member and seat member are measured by sensors
5. Loads as a percentage of operator's weight is determined at handle member and seat member
6. Percentage evaluation
   Percentage is looked up from stored data for handle member Percentage is looked up from stored data for seat member
Example of calculation (percentage values and percentage ranges are estimated for demonstration purposes)
Operator weight: 200 lbs.
Operator loading at handle member: 50 lbs.
Operator weight percentage at handle member: 25%
Operator loading at seat member: 100 lbs.
Operator weight percentage at seat member: 50%
If: handle member percentage≤25%
And
If: seat member percentage≥50%
Then: proper form
Display "proper riding form" or display nothing
If: handle member percentage>25%
And
If: seat member percentage≥50%
Then: improper form
Display "fix form at handle member" or other informative message
If: handle member percentage≤25%
And
If: seat member percentage<50%
Then: improper form
Display "fix form at seat member" or other informative message
If: handle member percentage>25%
And
If: seat member percentage<50%
Then: improper form
Display "fix form at seat member and handle member" or other informative message Example B2

1. Operator operates exercise equipment
2. Operator inputs body weight into controller
3. Operator applies load to handle member and seat member
4. Loads at handle member and seat member are measured by sensors
5. Loads as a percentage of operators weight is determined at handle member and seat member
6. Percentage evaluation
Percentage is looked up from stored data for handle member
Percentage is looked up from stored data for seat member
Example of calculation (percentage values and percentage ranges are estimated for demonstration purposes)
Operator weight: 200 lbs.
Operator loading at handle member: 50 lbs.
Operator weight percentage at handle member: 25%
Operator loading at seat member: 100 lbs.
Operator weight percentage at seat member: 50%
Percentage ratio value
25:50=0.5
If percentage ratio value≤0.5
Then: proper form
Display "proper riding form" or display nothing
If percentage ratio value>0.5
Then: improper form
Display "fix form" or other informative message Example B3

1. Operator operates exercise equipment
2. Operator inputs body weight into controller
3. Operator applies load to handle member and seat member
4. Loads at handle member and seat member are measured by sensors
5. Loads as a percentage of operators weight is determined at handle member and seat member
6. Percentage evaluation
Percentage is looked up from stored data for handle member
Percentage is looked up from stored data for seat member
Example of calculation (percentage values and percentage ranges are estimated for demonstration purposes)
Operator weight: 200 lbs.
Operator loading at handle member: 50 lbs.
Operator weight percentage at handle member: 25%
Operator loading at seat member: 100 lbs.
Operator weight percentage at seat member: 50%
If: handle member percentage<25%
Then: proper form at handle member
Display "proper riding form at handle member" or display nothing for handle member
If: handle member percentage>25%
Then: improper form at handle member
Display "fix form at handle member" or other informative message for handle member
If: seat member percentage>50%
Then: proper form at handle member
Display "proper riding form at seat member" or display nothing for seat member
If: seat member percentage<50%
Then: improper form
Display "fix form at seat member" or other informative message for seat member Example C1

1. Operator operates exercise equipment
2. Operator inputs body weight into controller
3. Operator applies load to handle member and seat member
4. Loads at handle member and seat member are measured by sensors
5. Loads as a percentage of operators weight is determined at handle member and seat member
6. Percentage evaluation
Percentage is looked up from stored data for handle member
Percentage is looked up from stored data for seat member
Example of calculation (percentage values and percentage ranges are estimated for demonstration purposes)
Operator weight: 200 lbs.
Operator loading at handle member: 50 lbs.
Operator weight percentage at handle member: 25%
Operator loading at seat member: 100 lbs.
Operator weight percentage at seat member: 50%
Operator loading at pedals: 50 lbs.
Operator weight percentage at pedals: 25%

If: handle member percentage≤25%
Then: proper form at handle member
Display "proper riding form at handle member" or display nothing for handle member
If: handle member percentage>25%
Then: improper form at handle member
Display "fix form at handle member" or other informative message for handle member
If: seat member percentage>50%
Then: proper form at handle member
Display "proper riding form at seat member" or display nothing for seat member
If: seat member percentage<50%
Then: improper form
Display "fix form at seat member" or other informative message for seat member
If: pedal member percentage≥25%
Then: proper form
Display "proper riding form at pedals" or display nothing for pedals
If: pedal member percentage<25%
Then: improper form
Display "fix form" or other informative message Example C2

1. Operator operates exercise equipment
2. Operator inputs body weight into controller
3. Operator applies load to handle member, seat member and pedals
4. Loads at handle member, seat member, and pedal member are measured by sensors
5. Loads as a percentage of operators weight is determined at handle member, seat member and pedal member
6. Percentage evaluation
Percentage is looked up from stored data for handle member
Percentage is looked up from stored data for seat member
Percentage is looked up from stored data for seat member
Example of calculation (percentage values and percentage ranges are estimated for demonstration purposes)
Operator weight: 200 lbs.
Operator loading at handle member: 50 lbs.
Operator weight percentage at handle member: 25%
Operator loading at seat member: 100 lbs.
Operator weight percentage at seat member: 50%
Operator loading at pedals: 50 lbs.
Operator weight percentage at pedal member: 25%
If: handle member percentage≤25%
And
If: seat member percentage≥50%
And
If: pedal member percentage≥25%
Then: proper form
Display "proper riding form" or display nothing
If: handle member percentage>25%
And
If: seat member percentage≥50%
And
If: pedal member percentage≥25%
Then: improper form
Display "fix form at handle member" or other informative message
If: handle member percentage≤25%
And
If: seat member percentage<50%
And
If: pedal member percentage>25%
Then: improper form
Display "fix form at seat member" or other informative message
If: handle member percentage<25%
And
If: seat member percentage≥50%
And
If: pedal member percentage<25%
Then: improper form
Display "fix form" or other informative message
If: handle member percentage>25%
And
If: seat member percentage<50%
And
Pedal member percentage<25%
Then: improper form
Display "bike setup required" or other informative message Example C3

1. Operator mounts exercise equipment
2. Operator inputs body weight into controller
3. Operator applies load at seat member, handle member, and pedal member
4. Loads at seat member, handle member, and pedal member are measures by sensors
5. Load is analyzed as components of operator weight.
If load measured at seat member+handle member+pedal member=input body weight±5%
Then bike setup is analyzed
If handle member load<20% of body weight
And
If 40%<seat member load<60% of body weight
And
If pedal member load>30% of body weight
Then proper equipment setup
Display nothing
If handle member load≠20% of body weight
And
If seat member load≠50% of body weight
And
If pedal member load>30% of body weight
Then improper equipment setup
Display "adjust seat member height".

In the present description, certain terms have been used for brevity, clearness and understanding. No unnecessary limitations are to be inferred therefrom beyond the requirement of the prior art because such terms are used for descriptive purposes only and are intended to be broadly construed. The different assemblies described herein may be used alone or in combination with other devices and/or assemblies. Various equivalents, alternatives and modifications are possible within the scope of the appended claims.

What is claimed is:

1. Exercise equipment comprising:
a handle member that is configured to be manually grasped by an operator;
a seat member that is configured to be sat on by the operator;
a first load sensor device that is configured to sense an operator-applied load amount on the handle member;

a second load sensor device that is configured to sense an operator-applied load amount on the seat member, a controller that is configured to determine a desired corrective change in operator posture based upon the operator-applied load amount on the handle member, the operator-applied load amount on the seat member, and a current body weight of the operator; and an indicator device that is configured to indicate the desired corrective change in operator posture.

2. The exercise equipment according to claim 1, wherein the controller comprises a memory that stores a look-up table that correlates operator-applied load amounts to stored corrective changes in operator posture, and wherein the controller is configured to determine the desired corrective change in operator posture by comparing the operator-applied load amount on the handle member to the look-up table.

3. The exercise equipment according to claim 1, wherein the controller is configured to calculate a split load amount between the operator-applied load amount on the handle member and the operator-applied load amount on the seat member, and wherein the desired corrective change in operator posture is calculated based upon the split load amount and the current body weight of the operator.

4. The exercise equipment according to claim 1, further comprising a pedal member that supports a foot of the operator during a pedaling motion by the operator, and further comprising a third load sensor device that is configured to sense an operator-applied load amount on the pedal member, and wherein the controller is configured to calculate the desired corrective change in operator posture based upon the operator-applied load amount on the handle member, the operator-applied load amount on the seat member, the operator-applied load amount on the pedal member, and the current body weight of the operator.

5. The exercise equipment according to claim 4, wherein the controller is configured to calculate a load amount distribution the operator-applied load amount on the handle member, the operator-applied load amount on the seat support member, and the operator-applied load amount on the pedal member, and wherein the desired corrective change in operator posture is calculated based upon the load amount distribution and the current body weight of the operator.

6. The exercise equipment according to claim 1, wherein the indicator device comprises a display configured to display the desired corrective change in operator posture.

7. The exercise equipment according to claim 1, further comprising an input device configured to input the current body weight of the operator to the controller.

8. A system for determining and indicating a desired corrective change in exercise technique, the system comprising:

an exercise apparatus that is configured for engagement by an operator during exercise at a first contact location and at a second contact location;

a first load sensor device that is configured to sense an operator-applied load amount at the first contact location;

a second load sensor device that is configured to sense an operator-applied load amount at the second contact location;

a controller that is configured to determine a desired corrective change in exercise technique based upon the operator-applied load amount at the first contact location, the operator-applied load amount at the second contact point, and a current body weight of the operator;

wherein the controller is configured to calculate a split load amount between the operator-applied load amount at the first contact point and the operator-applied load amount at the second contact point, and wherein the desired corrective change in exercise technique is calculated based upon the split load amount and the current body weight of the operator; and an indicator device that is configured to indicate the desired corrective change in exercise technique.

9. The system according to claim 8, wherein the exercise technique comprises a posture of the operator.

10. The system according to claim 8, wherein the exercise technique comprises a correct or incorrect fit between the exercise apparatus and the operator.

11. The system according to claim 8, wherein the controller comprises a memory that stores a look-up table that correlates operator-applied load amounts to stored corrective changes in exercise technique, and wherein the controller is configured to determine the desired corrective change in exercise technique by comparing the operator-applied load amount at the first contact location to the look-up table.

12. The system according to claim 8, further comprising a third contact location that is engaged by the operator during exercise, and further comprising a third load sensor device that is configured to sense an operator-applied load amount at the third contact location, and wherein the controller is configured to calculate the desired corrective change in exercise technique based upon the operator-applied load amount at the first contact location, the operator-applied load amount at the second contact location, the operator-applied load amount at the third contact location, and the current body weight of the operator.

13. The system according to claim 12, wherein the controller is configured to calculate a load amount distribution the operator-applied load amount at the first contact location, the operator-applied load amount at the second contact location, and the operator-applied load amount at the third contact location, and wherein the desired corrective change in operator posture is calculated based upon the load amount distribution and the current body weight of the operator.

14. The system according to claim 13, wherein the exercise apparatus comprises a stationary cycle, wherein the first contact location is a handle member of the stationary cycle, wherein the second contact location is a support seat of the stationary cycle, and wherein the third contact location is a pedal member of the stationary cycle.

15. The system according to claim 8, wherein the indicator device comprises a display configured to display the desired corrective change in operator posture.

16. The system according to claim 8, further comprising an input device configured to input the current body weight of the operator to the controller.

17. A method for determining and indicating a desired corrective change in exercise technique, the method comprising:

operating an exercise apparatus that is engaged by an operator at a first contact location and at a second contact location;

sensing an operator-applied load amount at the first contact location;

sensing an operator-applied load amount at the second contact location;

determining a desired corrective change in exercise technique based upon the operator-applied load amount at the first contact location, the operator-applied load amount at the second contact location, and a current body weight of the operator;

calculating a split load amount between the operator-applied load amount at the first contact location and the operator-applied load amount at the second contact location, and basing the desired corrective change in exercise technique upon the split load amount and the current body weight of the operator; and indicating the desired corrective change in exercise technique.

18. The method according to claim 17, wherein the desired corrective change in exercise technique comprises a posture of the operator.

19. The method according to claim 17, further comprising engaging the exercise apparatus at a third contact location, sensing an operator-applied load amount at the third contact location, and calculating the desired corrective change in exercise technique based upon the operator-applied load amount at the first contact location, the operator-applied load amount at the second contact location, the operator-applied load amount at the third contact location, and the current body weight of the operator.

20. The method according to claim 19, further comprising calculating a load amount distribution between the operator-applied load amount at the first contact location, the operator-applied load amount at the second contact location, and the operator-applied load amount at the third contact location, and basing the desired corrective change in exercise technique upon the load amount distribution and the current body weight of the operator.

21. The method according to claim 17, wherein the exercise technique comprises a correct or incorrect fit between the exercise apparatus and the operator.

22. A system for determining and indicating a desired corrective change in exercise technique, the system comprising:

an exercise apparatus that is configured for engagement by an operator during exercise at a first contact location, at a second contact location, and at a third contact location;

a first load sensor device that is configured to sense an operator-applied load amount at the first contact location;

a second load sensor device that is configured to sense an operator-applied load amount at the second contact location;

a third load sensor device this is configured to sense an operator-applied load amount at the third contact location;

a controller that is configured to determine a desired corrective change in exercise technique based upon the operator-applied load amount at the first contact location, the operator-applied load amount at the second contact location, the operator-applied load at the third contact location, and a current body weight of the operator;

wherein the controller is configured to calculate a load amount distribution the operator-applied load amount at the first contact location, the operator-applied load amount at the second contact location, and the operator-applied load amount at the third contact location, and wherein the desired corrective change in operator posture is calculated based upon the load amount distribution and the current body weight of the operator; and an indicator device that is configured to indicate the desired corrective change in exercise technique.

23. The system according to claim 22, wherein the exercise apparatus comprises a stationary cycle, wherein the first contact location is a handle member of the stationary cycle, wherein the second contact location is a support seat of the stationary cycle, and wherein the third contact location is a pedal member of the stationary cycle.

* * * * *